US008113889B2

(12) United States Patent
Zhang et al.

(10) Patent No.: US 8,113,889 B2
(45) Date of Patent: Feb. 14, 2012

(54) CABLE CONNECTOR ASSEMBLY WITH A UNITARY CONNECTOR MOLDED WITH ANOTHER CONNECTOR

(75) Inventors: Wei Zhang, Kunshan (CN); Hou-Yu Shi, Kunshan (CN); David Ko, Fullerton, CA (US)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/779,970

(22) Filed: May 14, 2010

(65) Prior Publication Data

US 2010/0291804 A1 Nov. 18, 2010

(30) Foreign Application Priority Data

May 14, 2009 (CN) ..... 200920303145.3

(51) Int. Cl.
*H01R 13/502* (2006.01)

(52) U.S. Cl. ..... 439/701; 439/606

(58) Field of Classification Search ..... 439/604, 439/606, 660, 701, 712, 715, 717, 724
See application file for complete search history.

(56) References Cited

U.S. PATENT DOCUMENTS

| | | | | |
|---|---|---|---|---|
| 5,580,264 | A * | 12/1996 | Aoyama et al. | 439/275 |
| 7,632,142 | B2 * | 12/2009 | Khemakhem et al. | 439/578 |
| 7,837,516 | B2 * | 11/2010 | Ko et al. | 439/701 |
| 2006/0110978 | A1 | 5/2006 | Fan et al. | |

* cited by examiner

*Primary Examiner* — Thanh Tam Le
(74) *Attorney, Agent, or Firm* — Wei Te Chung; Andrew C. Cheng; Ming Chieh Chang

(57) ABSTRACT

A cable connector assembly (200) includes a body portion (1) comprising a cylindrical first connector (11) and a cylindrical second connector (12), an insulative housing (2) connecting the first and second connectors (11, 12) together along a transverse direction thereof, a cable (5) connected with the body portion (1) and an insulative cover (4) over-molded on an electrical connection area between the body portion (1) and the cable (5). The first and second connectors (11, 12) each have a contact (3) located at a central axis thereof. The insulative housing (2) comprises an extending portion (23) extending along a back to front direction perpendicular to the transverse direction, the extending portion (23) locates between the first and second connectors (11, 12).

20 Claims, 4 Drawing Sheets

CABLE CONNECTOR ASSEMBLY WITH A UNITARY CONNECTOR MOLDED WITH ANOTHER CONNECTOR

BACKGROUND OF THE INVENTION

1. Field of the Invention

This application claims priority to prior Chinese patent applications 200920303145.3, the disclosure of which is incorporated herein by reference.

The present invention generally relates to a cable connector assembly, and more particularly to a cable connector assembly being replaced easily.

2. Description of Related Art

Conventional cable connector assemblies are widely used in an electronic equipment, especially for transmitting power, and the performance of the cable connector assembly directly impacts on the entire electronic equipment.

A cable connector assembly is a power connector and comprises a first connector and a second connector. An insulative housing is over-molded with the first and second connectors. A power contact is received in the first connector. A signal contact is received in the second connector. An insulative cover covers the first connector and the second connector. The insulative housing conjuncts the first connector with the second connector along a transverse direction. However, when the cable connector assembly needs updating, the accessories of the cable connector assembly are inconvenient to change to achieve the updating, then it needs to design another cable connector assembly to meet the requirements of market.

Hence, an improved cable connector assembly is desired to overcome the above problems.

BRIEF SUMMARY OF THE INVENTION

According to one aspect of the present invention, a cable connector assembly comprises: a body portion comprising a cylindrical first connector and a cylindrical second connector, the first and second connectors each having a contact located at a central axis thereof; an insulative housing connecting the first and second connectors together along a transverse direction thereof, the insulative housing comprising an extending portion extending along a back to front direction perpendicular to the transverse direction, the extending portion located between the first and second connectors; a cable connected with the body portion; and an insulative cover over-molded on an electrical connection area between the body portion and the cable.

According to another aspect of the present invention, a cable connector assembly for mating with a corresponding receptacle connector, comprising: a body portion having a first connector and a second connector side by side connected with each other by an insulative housing along a transverse direction, the first and second connectors presenting as annularity-shaped and each defining a slit recessed from an inner wall thereof for engaging with a protrusion of the receptacle connector; The insulative housing having an extending portion extending along a back to front direction between the first and second connectors for engaging with the receptacle connector; a cable connected with the body portion; and an insulative cover over-molded on an electrical connection area between the body portion, the insulative housing and the cable.

The foregoing has outlined rather broadly the features and technical advantages of the present invention in order that the detailed description of the invention that follows may be better understood. Additional features and advantages of the invention will be described hereinafter which form the subject of the claims of the invention.

DETAILED DESCRIPTION OF THE INVENTION

Figure 1:
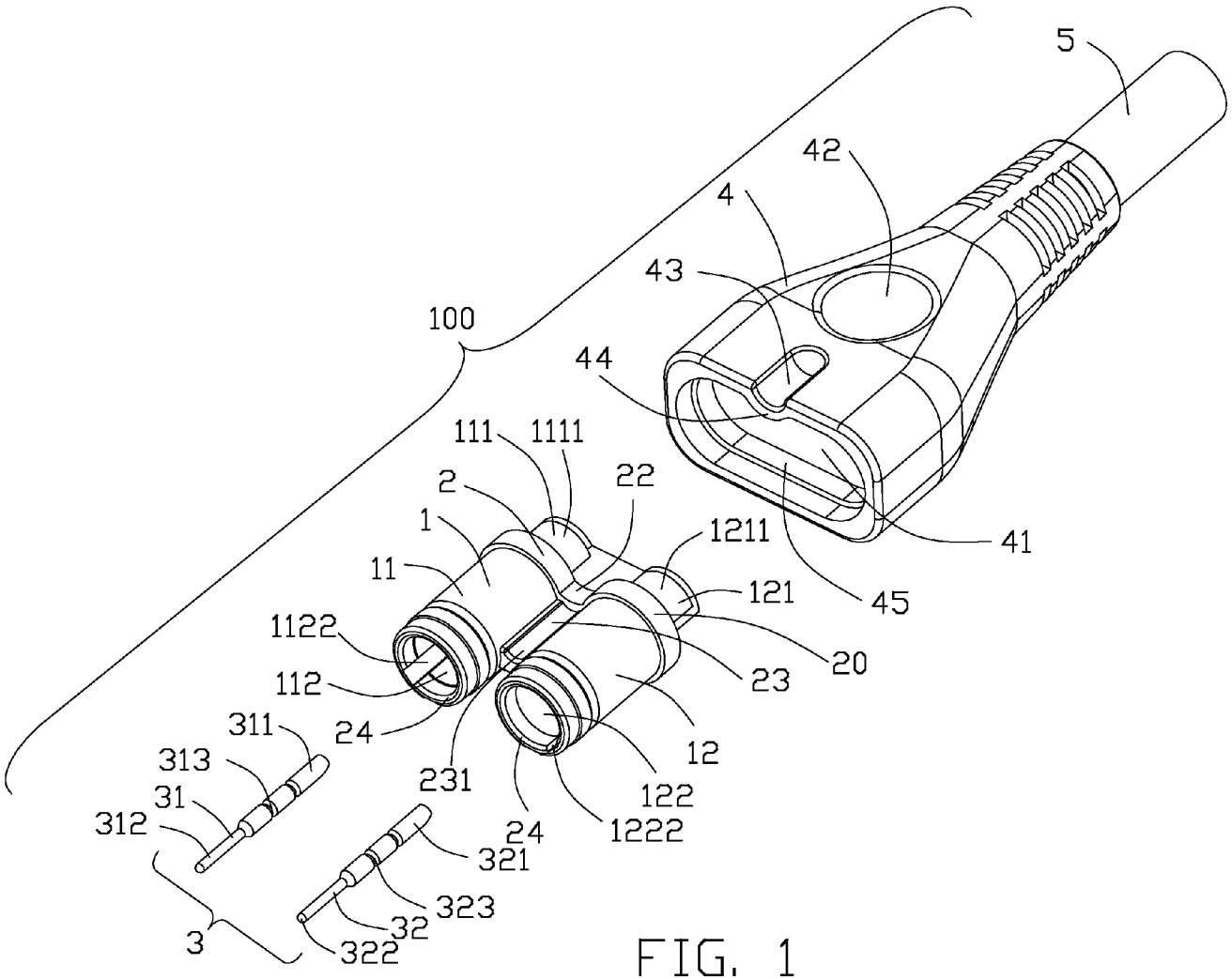
FIG. 1 is an exploded, perspective view of a cable connector assembly in the present invention.

Reference will now be made to the drawing figures to describe the present invention in detail.

Referring to FIGS. 1-4, a cable connector assembly 100 in accordance with the present invention comprises a body portion 1, an insulative housing 2 being formed integrally with the body portion 1, an insulative cover 4 and a cable 5 connected with the body portion 1. The insulative cover 4 is over-molded on an electrical connection area between the body portion 1 and the cable 5. The insulative cover 4 covers part of the body portion 1 and the insulative housing 2. The cable connector assembly 100 is mating with a corresponding receptacle 200.

Referring to FIGS. 1-4, the body portion 1 comprises a cylindrical first connector 11 and a cylindrical second connector 12. The first and second connectors 11, 12 present as annularity-shaped. Each first and second connectors 11, 12 have a contact 3 located at a central axis thereof. The first and second connectors 11, 12 extend along a back to front direction.

Figure 2:
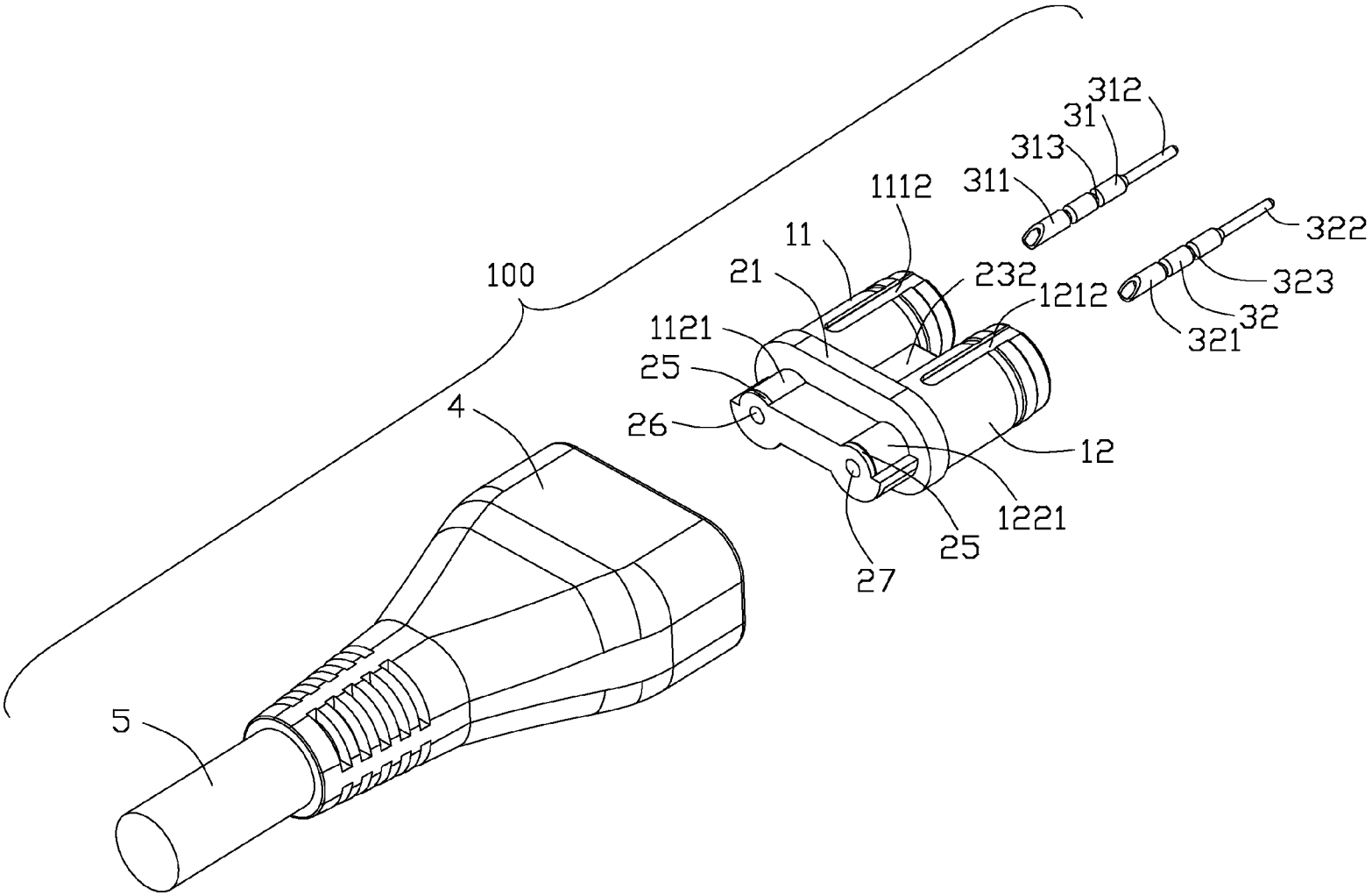
FIG. 2 is similar to FIG. 1, but viewed from another aspect.
Figure 3:
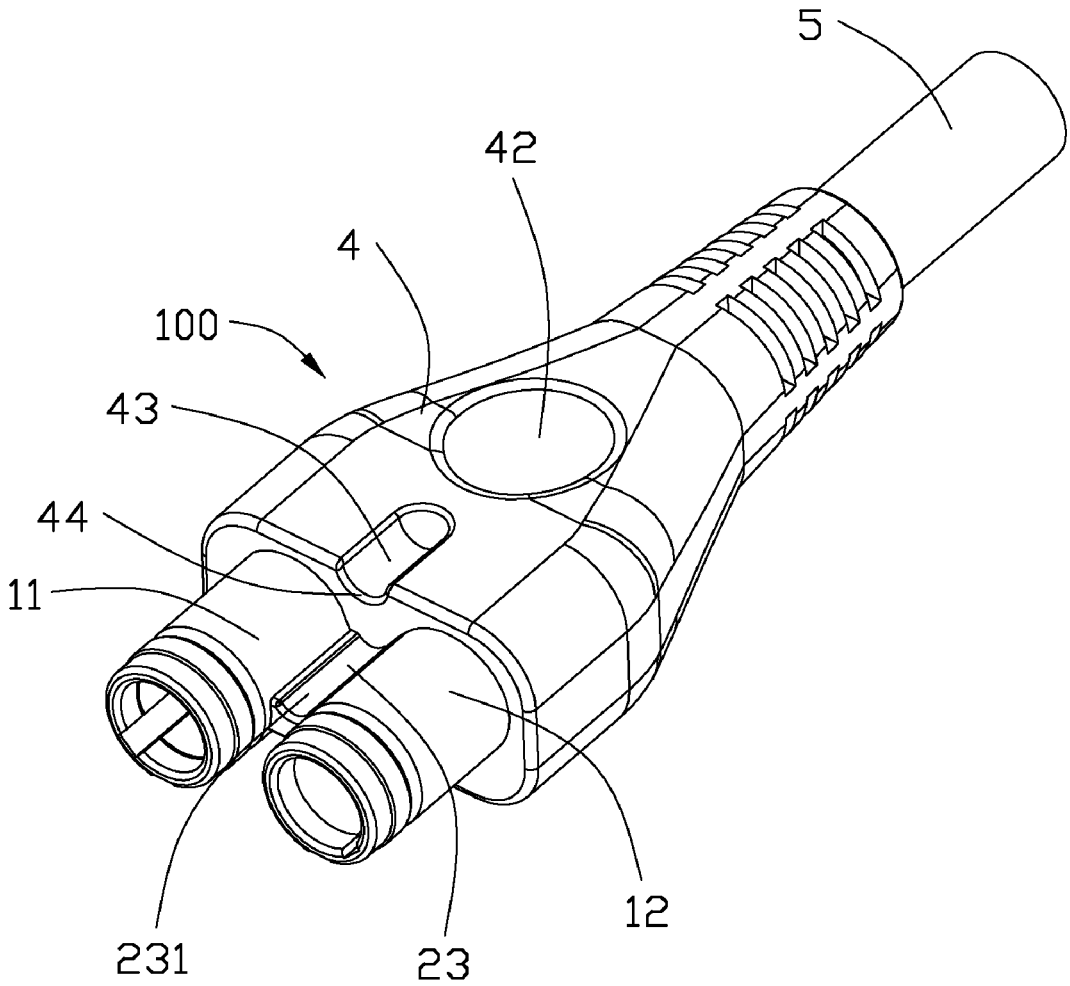
FIG. 3 is an assembled, perspective view of the cable connector assembly.

Referring to FIGS. 1-2, the first and second connectors 11, 12 each comprise an outer tube and an inner tube spaced apart from the outer tube along a radius direction thereof. The outer tubes include first outer tube 111 corresponding to the first connector 11 and second outer tube 121 corresponding to the second connector 12. The inner tubes include first inner tube 112 corresponding to the first connector 11 and second inner tube 122 corresponding to the second connector 12.

Referring to FIGS. 1-4, The first outer tube 111 has a first curved tail 1111 at a rear side thereof and a first notch 1112 at a front side thereof. The first inner tube 112 has a first curved portion 1121 at the rear side thereof and a first slit 1122 at the front side thereof. The second connector 12 is symmetrical with the first connector 11. The second outer tube 121 has a second curved tail 1211 at the rear side thereof and a second notch 1212 at the front side thereof. The second inner tube 122 has a second curved portion 1221 at the rear side thereof and a second slit 1222 at the front side thereof.

Referring to FIGS. 1-2, the insulative housing 2 is made of plastic material. The insulative housing 2 is insert-molded with the body portion 1. The insulative housing 2 includes a connector portion 20 side by side connecting the first and second connectors 11, 12 along a transverse direction thereof, and an extending portion 23 extending forwardly from the connector portion 20.

Referring to FIGS. 1-2, the extending portion 23 extends along the back to front direction perpendicular to the transverse direction. The extending portion 23 locates between the first and second connectors 11, 12. The extending portion 23 comprises a curved groove 231 at one side thereof and a flat surface 232 at another side thereof. The flat surface 232 is located at the bottom of the extending portion 23, and the curved groove 231 is located at the top of the extending portion 23 and extends along the back to front direction. The extending portion 23 does not extend beyond a front end of the first and second connectors 11, 12 along the back to front direction.

Referring to FIGS. 1-2, the connection portion 20 is formed with a convex rib 21 and a recess 22 at two sides thereof. The convex rib 21 aligns with the recess 22 along an up to down direction. The extending portion 23 does not extend beyond the convex rib 21 and an inner wall of the recess 22 along the up to down direction thereof.

Referring to FIGS. 1-2, the insulative housing 2 further includes two insulative tubes 24, two insulative tails 25, a first hole 26 extending along a front to back direction of the first connector 11, a second hole 27 extending along the front to back direction of the second connector 12.

Referring to FIGS. 1-2, One of the insulative tube 24 is located at a front end of the first outer tube 111 and the first inner tube 112, the other of the insulative tube 24 is located at a front end of the second outer tube 121 and the second inner tube 122. The insulative tails 25 align with each other along the transverse direction. One of the insulative tails 25 covers the first curved tail 1111 and the first curved portion 1121, the other of the insulative tail 25 covers the second curved tail 1211 and the second curved portion 1221.

Referring to FIGS. 1-2, the contacts 3 includes a power contact 31 in the first connector 11 and a signal contact 32 in the second connector 12. The power contact 31 and the signal contact 32 are made of conductive material. The power contact 31 is used for transmitting power and the signal contact 32 is used for transmitting signal. The power and signal contacts 31, 32 comprise a connecting portion in a back end thereof and a contacting portion in a front end thereof, the connecting portions define a diameter which is larger than that of the corresponding contacting portions.

Referring to FIGS. 1-2, The connecting portions include first connecting portion 311 corresponding to the power contact 31 and second connecting portion 321 corresponding to the signal contact 32. The contacting portions include first contacting portion 312 corresponding to the power contact 31 and second contacting portion 322 corresponding to the signal contact 32. The contacts define a plurality of grooves recessed from an outer surface thereof for engaging with the insulative housing 2 to enhance the combinations between the contact 3 and the insulative housing 2. The grooves include first grooves 313 corresponding to the power contact 31 and second grooves 323 corresponding to the signal contact 32.

Referring to FIG. 1, the insulative cover 4 is assembled to an outer side of the body portion 1 and the cable 5. The insulative cover 4 is made of plastic material. The insulative cover 4 includes a receiving cavity 41 recessed from a front end thereof for receiving the first connector 11 and the second connector 12. A circular pressing portion 42 is recessed downwards from a top surface of the insulative cover 4. An indentation 43 is defined in a front end of the insulative cover 4 and recessed downwards from a top surface of the insulative cover 4 for preventing the cable connector assembly 100 from mis-mating with the corresponding receptacle 200. The indentation 43 is located in front of the pressing portion 42. A protrusion 44 is formed at a lower side of the indentation 43. A convex set 45 is defined in a front end of the receiving cavity 41 and formed in an inner surface of the receiving cavity 41.

The cable 5 comprises a plurality of wires (not shown) connected with the first connector 11 and the second connector 12, and each wire comprises three conductors (not shown). The wires includes a first group wire and a second group wire. The three conductors of the first group wire is electrically connected with the power contact 31, the first outer tube 111 and the first inner tube 112 respectively. The three conductors of the second group wire are electrically connected with the signal contact 32, the second outer tube 121 and the second inner tube 122 respectively.

In assembly, firstly, insert-molding the first and second connectors 11, 12 to the insulative housing 2; Secondly, assembling the insulative cover 4 to the body portion 1 and the cable 5, then the protrusion 44 is engaged with the curved groove 231 of the extending portion 23, the convex set 45 of the insulative cover 4 presses the convex rib 21 at the back end of the insulative housing 2 from the back to front direction.

Figure 4:
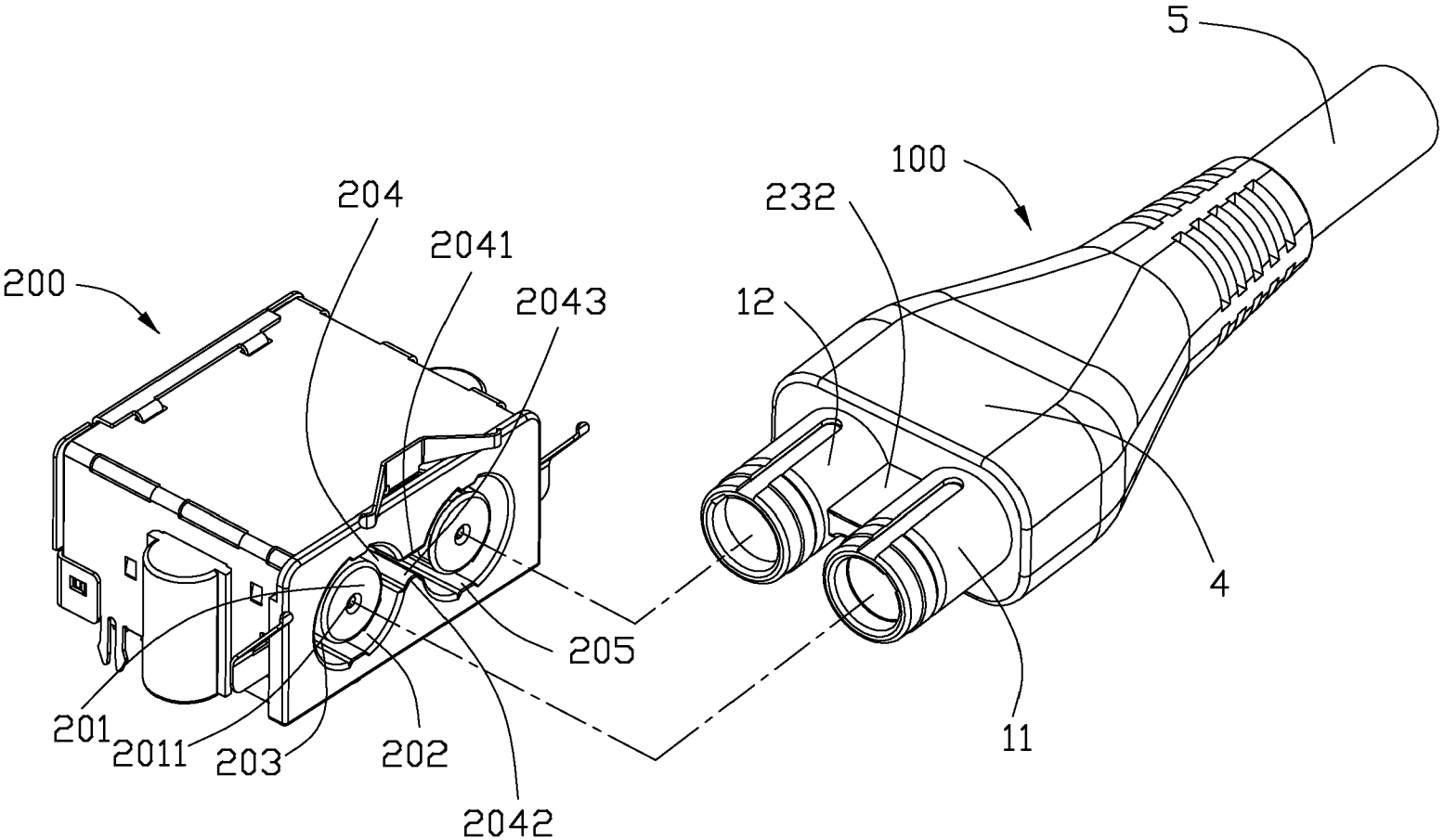
FIG. 4 is an assembled, perspective view of the cable connector assembly and a corresponding receptacle.

Referring to FIG. 4, the corresponding receptacle 200 is mating with the cable connector assembly 100. The corresponding receptacle 200 includes a pair of cylindrical portion 201 received in the first connector 11 and the second connector 12 respectively, an inner surface 202 at the outside of the cylindrical portions 201, and a gap 203 between the cylindrical portion 201 and the inner surface 202. The first connector 11 and the second connector 12 are received in the gap 203. The two cylindrical portions 201 are separated with each other. Each cylindrical portion 201 has an engaging hole 2011 extending along the front to back direction for engaging with the contact 3. A plurality of protrusion 205 engages with the first and second notches 1112, 1212, and the first and second slits 1122, 1222.

An updating structure 204 is located between the two cylindrical portions 201. The updating structure 204 includes a flat projection 2041 extending downwardly, a semi-circular projection 2042 extending upwardly, and a space 2043 between the flat projection 2041 and the semi-circular projection 2042. The semi-circular projection 2042 is below the flat projection 2041. The extending portion 23 of the insulative housing 2 is received in the space 2043. The flat projection 2041 is engaged with the flat surface 232 of the extending portion 23. The semi-circular projection 2042 is engaged with the curved groove 231 of the extending portion 23. The semi-circular projection 2042 guides the cable connector assembly 100 to promote into the gap 203 easily.

As described above, the cable connector assembly 100 further includes the extending portion 23 extending forwardly between the first connector 11 and the second connector 12. Thereby the extending portion 23 distinguishes the cable connector assembly 100 from normal connector which does not have said extending portion 23, and facilitates replacement of the cable connector assembly 100. Besides, the extending portion 23 defines the curved groove 231 which is easily to change for defining next generation of the cable connector assembly 100.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly, comprising:

a body portion comprising a cylindrical first connector and a cylindrical second connector, the first and second connectors each having a contact located at a central axis thereof;

a one-piece insulative housing connecting and enclosing the first and second connectors together along a transverse direction thereof simultaneously, the insulative housing comprising an extending portion extending along a back to front direction perpendicular to the transverse direction, the extending portion sandwiched in between the first and second connectors;

a cable connected with the body portion; and an insulative cover over-molded on an electrical connection area between the body portion and the cable.

2. The cable connector assembly as claimed in claim 1, wherein the extending portion defines a curved groove at one side thereof.

3. The cable connector assembly as claimed in claim 2, wherein the extending portion further defines a flat surface at another side thereof, the flat surface is located at the bottom of the extending portion, and the curved groove is located at the top of the extending portion and extends along the back to front direction.

4. The cable connector assembly as claimed in claim 1, wherein the first and second connectors extend along the back to front direction, the extending portion does not extend beyond a front end of the first and second connectors along the back to front direction.

5. The cable connector assembly as claimed in claim 1, wherein the insulative housing has a connection portion connecting the first and second connectors, the extending portion extends forwardly from the connection portion.

6. The cable connector assembly as claimed in claim 5, wherein the connection portion is formed with a convex rib and a recess at two sides thereof, the convex rib aligns with the recess along an up to down direction.

7. The cable connector assembly as claimed in claim 6, wherein the extending portion does not extend beyond the convex rib and an inner wall of the recess along the up to down direction thereof.

8. The cable connector assembly as claimed in claim 1, wherein the insulative housing is insert-molded with the body portion, the first and second connectors each comprise an outer tube and an inner tube spaced apart from the outer tube along a radius direction.

9. The cable connector assembly as claimed in claim 1, wherein the contact includes a power contact and a signal contact, the power and signal contacts comprise a connecting portion in a back end and a contacting portion in a front end, the connecting portions define a diameter which is larger than that of the corresponding contacting portions, the contacts define a plurality of grooves recessed from an outer surface thereof to engage with the insulative housing.

10. The cable connector assembly as claimed in claim 2, wherein the insulative cover includes a receiving cavity recessed from a front end for receiving the body portion and the insulative housing, and a protrusion projected downwardly to the receiving cavity, the protrusion engages with the curved groove of the extending portion.

11. A cable connector assembly for mating with a corresponding receptacle connector, comprising:

a body portion having a first connector and a second connector side by side connected with each other by an insulative housing along a transverse direction, the first and second connectors presenting as annularity-shaped and each defining a slit recessed from an inner wall thereof for engaging with a protrusion of the receptacle connector;

the insulative housing having an extending portion extending along a back to front direction between the first and second connectors for engaging with the receptacle connector;

a cable connected with the body portion; and an insulative cover over-molded on an electrical connection area between the body portion, the insulative housing and the cable.

12. The cable connector assembly as claimed in claim 11, wherein the extending portion defines a curved groove at one side thereof.

13. The cable connector assembly as claimed in claim 12, wherein the extending portion further defines a flat surface at another side thereof, the flat surface is located at the bottom of the extending portion, and the curved groove is located at the top of the extending portion and extends along the back to front direction.

14. The cable connector assembly as claimed in claim 11, wherein the first and second connectors extend along the back to front direction, the extending portion does not extend beyond a front end of the first and second connectors along the back to front direction.

15. The cable connector assembly as claimed in claim 11, wherein the insulative housing has a connection portion connecting the first and second connectors, the connection portion is formed with a convex rib and a recess at two sides thereof, the extending portion does not extend beyond the convex rib and an inner wall of the recess along an up to down direction.

16. An electrical connector assembly comprising:

a receptacle connector defining a first front mating face and two tubular mating cavities linked by a transverse passage in a transverse direction, said two tubular mating cavities extending rearwardly from the first front mating face with a first distance in a front-to-back direction perpendicular to said transverse direction while said transverse passage extending rearwardly from the first front mating face with a second distance, in the front-to-back direction, smaller than the first distance;

a plug connector defining a second mating face adapted to intimately confront the first mating face, and two columnar mating sections linked by a transverse bar in the transverse direction, said two columnar mating sections extending forwardly from the second front mating face with a third distance in the front-to-back direction while the transverse bar extending forwardly from the second front mating face with a fourth distance, in the front-to-back direction, smaller than the third distance.

17. The electrical connector assembly as claimed in claim 16, wherein each the transverse passage and the transverse bar is asymmetrical in a vertical direction so as to achieve only one orientation therebetween during mating.

18. The electrical connector assembly as claimed in claim 16, wherein the third distance complies with the first distance, and the fourth distance complies with the second distance.

19. The electrical connector assembly as claimed in claim 16, wherein the transverse passage is dimensioned smaller than a diameter of the tubular mating cavity in a vertical direction perpendicular to both the transverse direction and the front-to-back direction, and the transverse bar is dimensioned smaller than a diameter of the columnar mating section in the vertical direction.

20. The electrical connector assembly as claimed in claim 16, when mated, the columnar mating sections are received in the corresponding tubular mating cavities, respectively, and the transverse bar is received in the transverse passage.

* * * * *